US006745609B2

(12) United States Patent
Garnett et al.

(10) Patent No.: US 6,745,609 B2
(45) Date of Patent: Jun. 8, 2004

(54) SHEET METAL FORMING DIE ASSEMBLY WITH TEXTURED DIE SURFACES

(75) Inventors: Mark D Garnett, Oakland, MI (US); William A Marttila, Rochester, MI (US); Zhicong Yao, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/288,948

(22) Filed: Nov. 6, 2002

(65) Prior Publication Data

US 2004/0083786 A1 May 6, 2004

(51) Int. Cl.[7] ..... B21D 24/04
(52) U.S. Cl. ..... 72/350; 72/347
(58) Field of Search ..... 72/350, 351, 422

(56) References Cited

U.S. PATENT DOCUMENTS

| | | | |
|---|---|---|---|
| 5,054,682 | A | 10/1991 | Mistry |
| 5,223,347 | A | 6/1993 | Lhymn et al. |
| 5,328,776 | A | 7/1994 | Garber et al. |
| 5,852,272 | A | 12/1998 | Amano |
| 5,881,480 | A | 3/1999 | Fall |
| 5,989,310 | A | 11/1999 | Chu et al. |
| 6,036,792 | A | 3/2000 | Chu et al. |
| 6,122,564 | A | 9/2000 | Koch et al. |
| 6,139,658 | A | 10/2000 | Davies et al. |

FOREIGN PATENT DOCUMENTS

| | | | | |
|---|---|---|---|---|
| GB | 2 092 926 A | * | 8/1982 | ..... 72/350 |
| JP | 56-33172 | * | 4/1981 | ..... 72/350 |
| RU | 2013163 | * | 5/1994 | ..... 72/350 |

* cited by examiner

*Primary Examiner*—Lowell A. Larson
(74) *Attorney, Agent, or Firm*—Thomas A. Jurecko

(57) ABSTRACT

An improved stamping die assembly is provided for controlling the flow of sheet metal during the draw forming process. The die assembly includes a textured die surface on the one or both sides of the binder mating surfaces that replaces conventional draw and lock beads. The textured die surface can be formed using direct metal deposition of a hard material, harder than the existing die surfaces, on the existing die base material to achieve an engineered textured surface. The textured die surface optimizes the performance of the die by enabling longer die life, higher coefficients of friction between the mating binder surfaces and reduction of wrinkles and stringers typically caused by draw and lock beads in the draw forming process.

17 Claims, 4 Drawing Sheets

SHEET METAL FORMING DIE ASSEMBLY WITH TEXTURED DIE SURFACES

FIELD OF THE INVENTION

The present invention relates in general to a sheet metal forming die assembly. More specifically, but without restriction to the particular embodiment and/or use which is shown or described for purposes of illustration, the present invention relates to an improved sheet metal draw forming die assembly with textured surfaces.

BACKGROUND OF THE INVENTION

Sheet metal draw forming and stamping die assemblies have been used for many years to form various sheet metal components. Draw forming press assemblies are used in the automotive industry to form various outer body panels such as a hood, roof or door exterior panel. A typical configuration for an outer body panel draw forming press assembly would include a press, an upper die, a lower punch, a lower binder, a lower shoe, a press bed and cushion pins.

As is well known in the art, draw beads and lock beads are commonly used in the upper die and lower binder mating surfaces to control the flow of the sheet metal during the forming process. The mating components of the draw and lock beads are machined into the binder and upper die mating surfaces, respectively. Draw and lock beads usually consist of geometric shapes that include sharp radii and are designed to locally control and even stop sheet metal flow during the forming operation. A disadvantage of the draw and lock beads is that they are subject to high wear. To service and repair the beads, the die and binder are typically removed from the press.

Utilizing draw and/or lock beads in the press assemblies can require additional press tonnage to prevent uplift between the binder and upper die as the sheet metal attempts to flow around the bead geometry during the draw forming process. Furthermore, additional material is required beyond the product trim line to form the sheet metal into the bead configuration. In addition, draw and lock beads can cause sheet metal wrinkling and stringers as the sheet metal flows in relation to the beads during the draw forming process. The die and binder repairs, sheet metal stringers and wrinkles, additional press tonnage and extra sheet metal stock required for the bead geometry all increase the costs and decrease the productivity of manufacturing automotive sheet metal outer body panels.

Thus, there is a need for improved sheet metal flow control in a draw forming die assembly that overcomes the aforementioned drawbacks incurred when using draw and/or lock beads to control the sheet metal flow during the forming process.

SUMMARY OF THE INVENTION

Accordingly, the present invention eliminates or significantly reduces the need for draw and/or lock beads by providing a textured die surface for controlling sheet metal flow during the draw forming process. In accordance with one aspect of the present invention, a textured die surface is formed on a binder surface of a draw forming die assembly that is arranged to engage the sheet metal. The textured die surface increases the coefficient of friction between the binder surface and the sheet metal when the sheet metal is clamped between the binder surface and an upper die assembly perimeter surface during the draw forming process.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

Other aspects, features, and advantages of the present invention will become more fully apparent from the following detailed description of the preferred embodiment, the appended claims, and in the accompanying drawings in which:

DETAILED DESCRIPTION OF THE PREFERRED EMBODIMENT

In the following description, numerous specific details are set forth in order to provide a more comprehensive description of the present invention. It will become apparent, however, to one skilled in the art, that the present invention may be practiced without these specific details. In other instances, specific details of well-known features have not been described so as to not obscure the present invention.

Figure 1A:
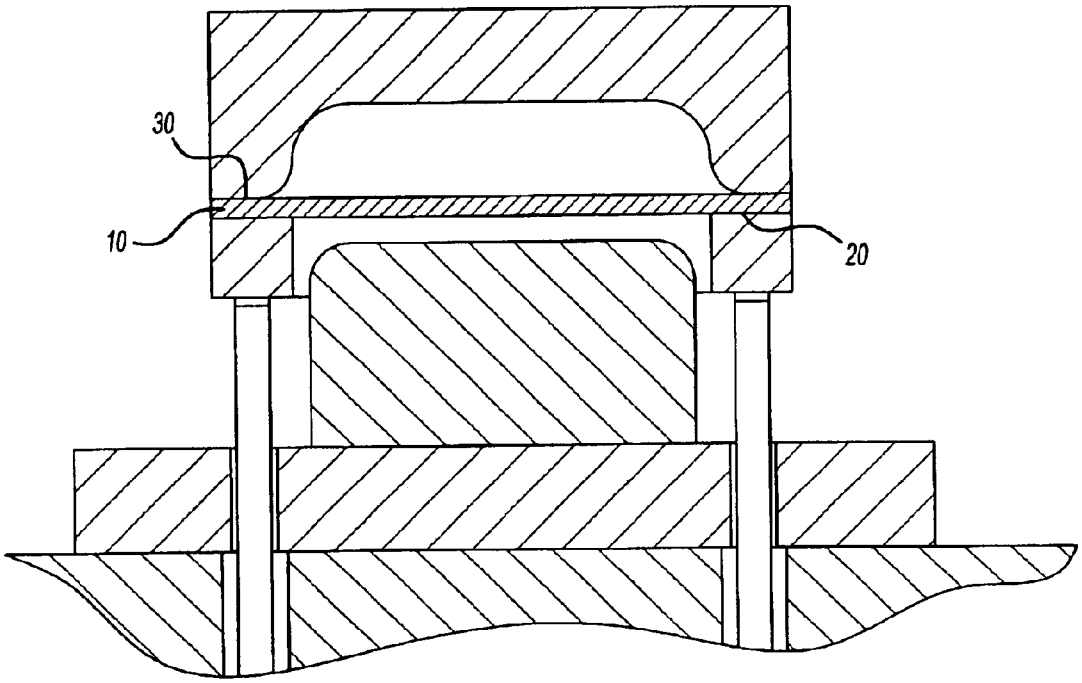
Fig-1A PRIOR ART
FIG. 1A is a sectional view of a conventional three-piece die assembly arrangement.
Figure 1B:
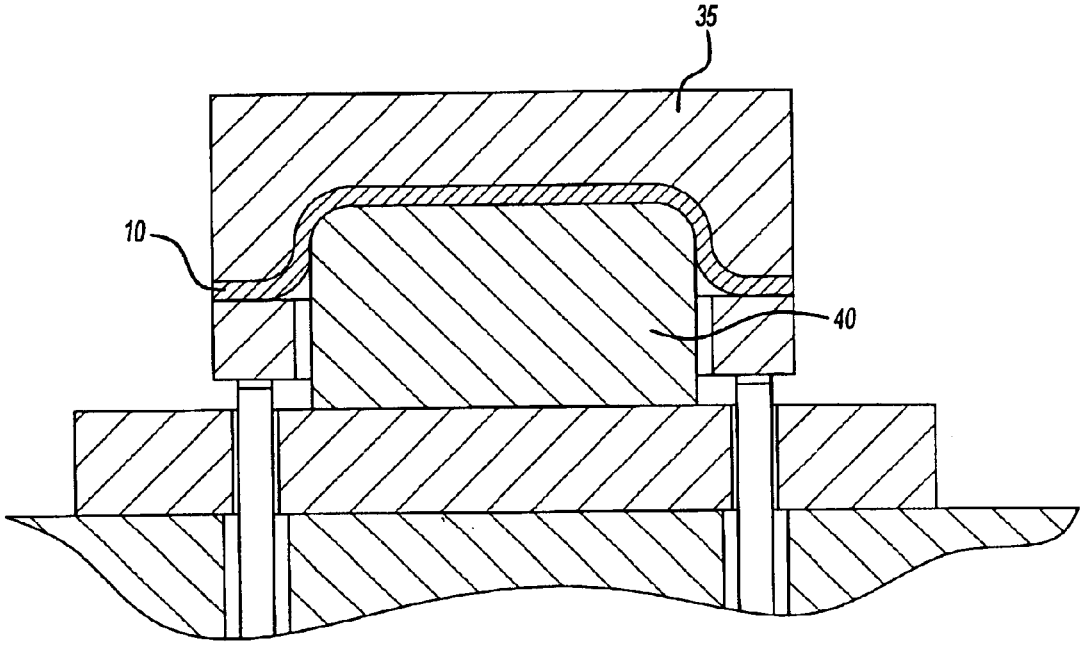
Fig-1B PRIOR ART
FIG. 1B is a sectional view of the conventional die assembly of FIG. 1 shown after the upper die has draw formed the sheet metal over the lower punch.

Referring now to the drawings, FIG. 1A illustrates a typical draw form die assembly arrangement with a flat binder face. The sheet metal 10 is in its original, preformed state secured by pressure between the lower binder face 20 and the upper die mating face 30. FIG. 1B illustrates the die assembly in its post form state after a press (not shown) has imparted a force on the upper die 35 to form the sheet metal 10 over the lower punch 40 into the desired part.

Figure 2:
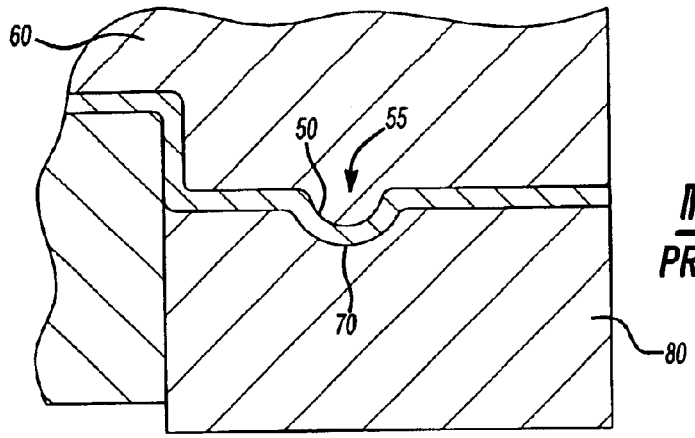
Fig-2 PRIOR ART
FIG. 2 is a sectional view of a convention draw bead arrangement.
Figure 3:
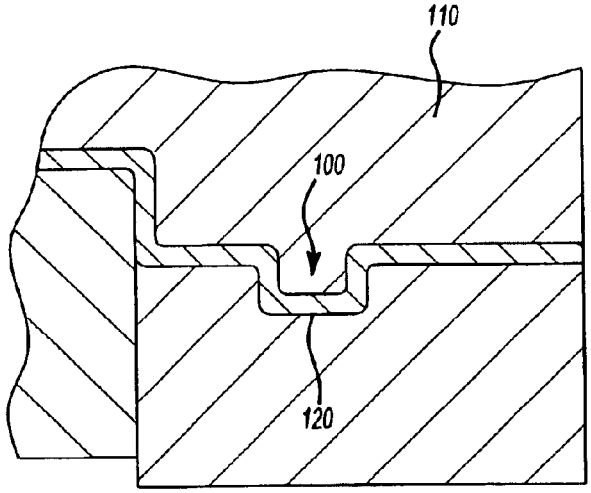
Fig-3 PRIOR ART
FIG. 3 is a sectional view of a conventional lock bead arrangement.

During this process, the force imparted on the sheet metal by the upper die causes movement or stretching of the sheet metal, i.e. flow of the sheet metal at various locations in the die assembly. To control this sheet metal flow and increase the retention strength between the upper die and binder mating faces, draw beads and/or lock beads are used as shown in FIGS. 2 and 3, respectively. FIG. 2 illustrates a conventional draw bead arrangement where the male portion 50 of the draw bead 55 is machined into the upper die 60 and the mating female portion 70 of the draw bead 55 is machined into the binder 80. FIG. 3 illustrates a conventional lock bead arrangement 100 machined into the upper die 110 and binder face 120 in the same manner as the draw bead. The lock 100 bead is designed to locally stop sheet metal flow during the forming process and thus utilizes sharper radii when compared to draw bead 55.

Note that FIGS. 1–3 describe stamping and forming arrangements known in the art for illustration purposes only. It should be understood that not every feature of stamping and forming press assemblies are described and that this invention, as described below, can be applied to a variety of sheet metal stamping and forming press assemblies and the scope of the this invention is not to be limited by the arrangements shown and described in connection with FIGS. 1–3.

Figure 4:
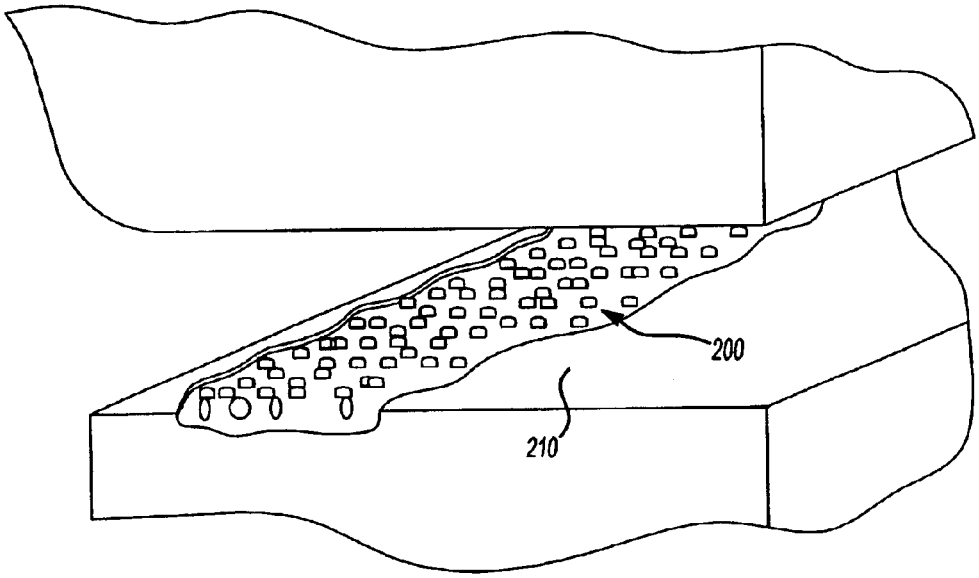
FIG. 4 is an exploded view of a textured die surface on the binder surface in accordance with the present invention.

Referring now to FIG. 4, a preferred embodiment of a textured draw die surface is shown in exploded view. The textured surface 200 is preferably created by direct metal deposition. Direct metal deposition is generally known to one of ordinary skill in the art and can be accomplished in several ways. Fundamental to the process is an intense, localized heat source that creates a molten pool in the substrate at a specific focal point. Metallic particles are simultaneously fed into the focal point area of the substrate molten pool and become dispersed throughout the molten pool volume. Subsequently, particle feeding and the application of heat are ceased, which results in a rapid cooling of the molten pool and a metallurgically bonded deposition on the outer layer of the substrate is formed. Direct metal deposition of particles of varying melting and/or hardness properties thus enables the deposition of hard material metallurgically bonded to the existing die base material to achieve an engineered textured surface.

Figure 5:
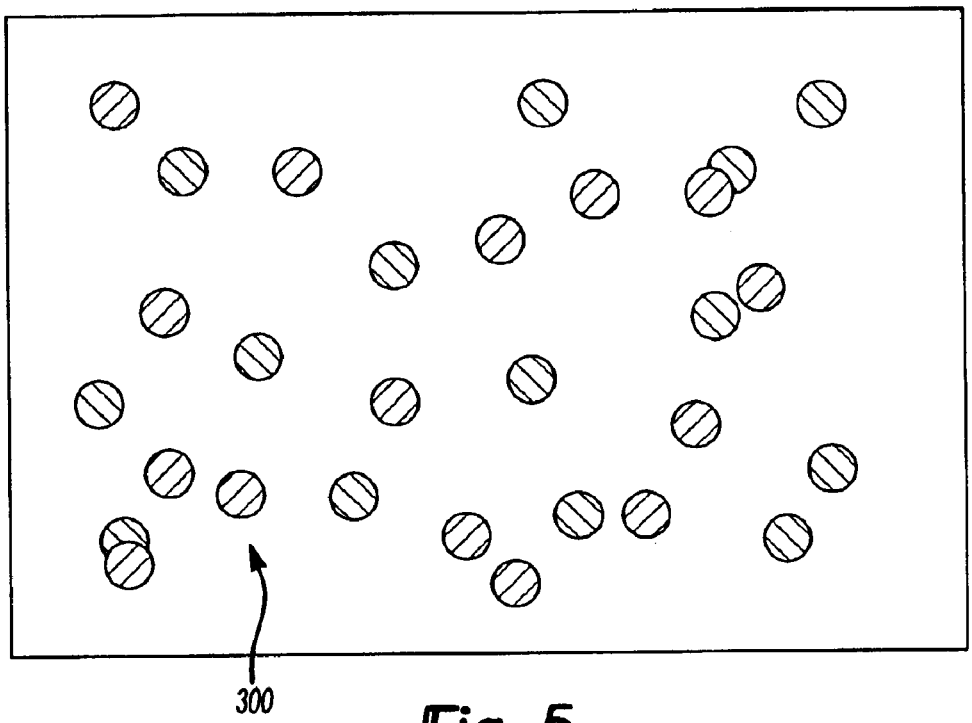
FIG. 5 is an illustration of a randomly dispersed particle textured die surface in accordance with the present invention.
Figure 6:
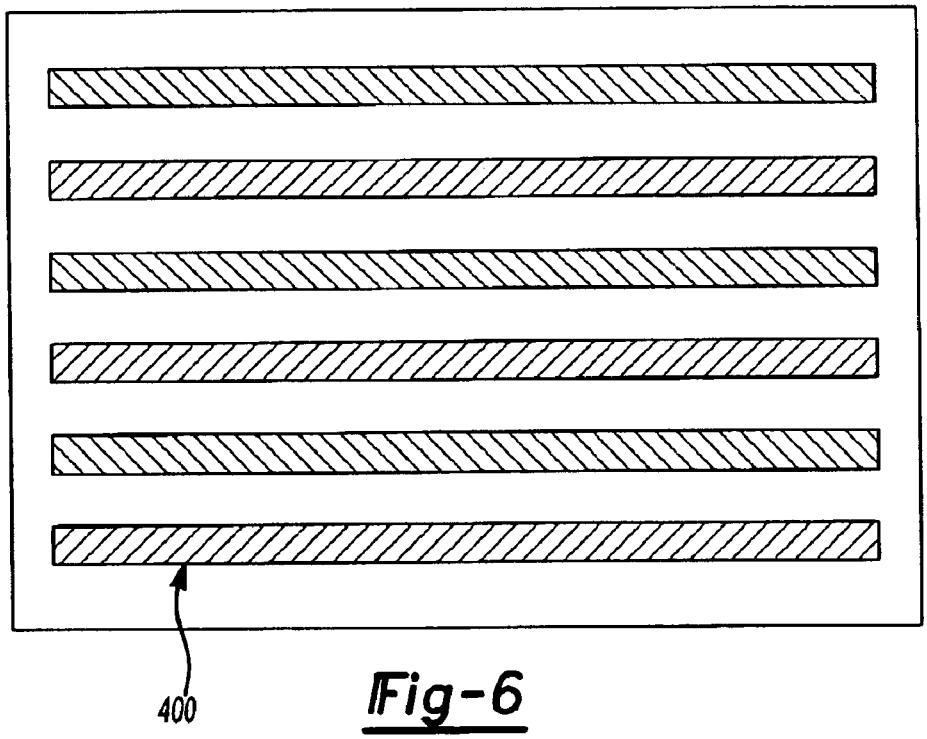
FIG. 6 is an illustration of a continuous bead textured die surface in accordance with the present invention.
Figure 7:
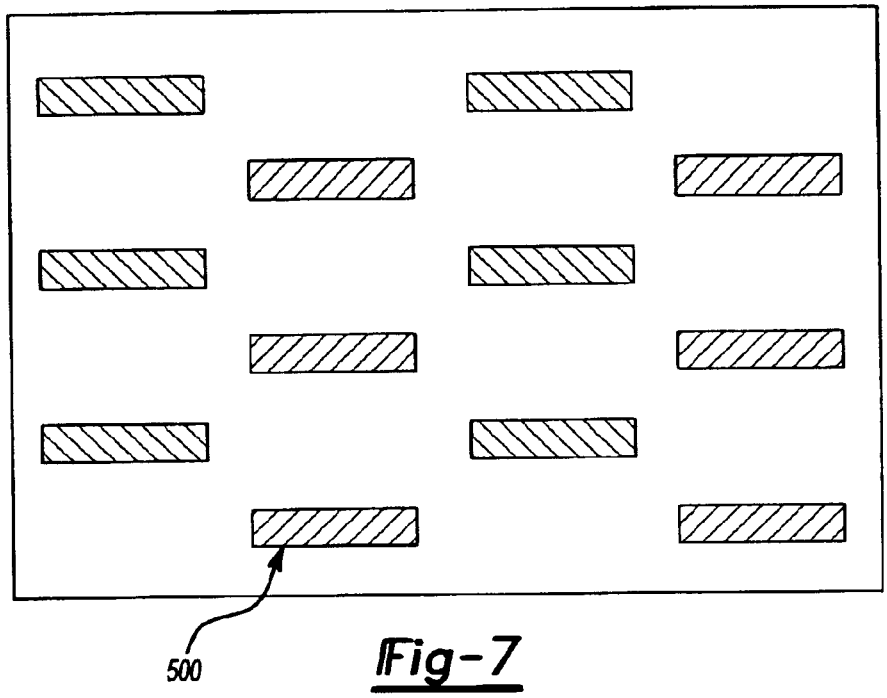
FIG. 7 is an illustration of a segmented bead textured die surface in accordance with the present invention.

Thus, in accordance with the present invention, the textured die surface is designed to replace or significantly reduce the need for conventional draw beads and lock beads. In a preferred embodiment shown in FIG. 4, the textured surface 200 is applied to the lower binder surface 210 only. The size of the particles used in creating the textured surface can be varied depending on the specific frictional requirements of the press forming operation. Furthermore, different material particles, such as carbide, can be utilized in the textured surface depending on the wear resistance characteristics required. Finally, also depending on the process wear and frictional requirements, different particle patterns can be deposited onto a die surface as shown in FIGS. 5, 6 and 7. FIG. 5 illustrates an example of a randomly dispersed particle pattern 300; FIG. 6 illustrates an example of particles deposited in a continuous bead pattern; and FIG. 7 illustrates an example of particles deposited in a segmented bead pattern 500.

Figure 8:
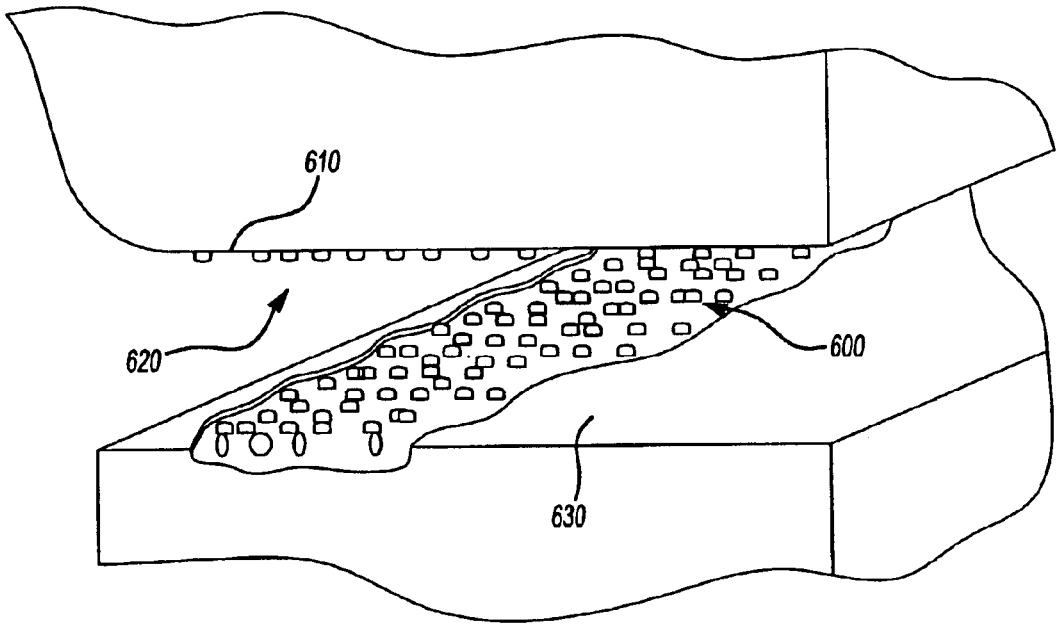
FIG. 8 is an exploded view of a textured die surface on both the binder surface and the upper die perimeter die surface in accordance with the present invention.

Another embodiment of the present invention is shown in FIG. 8, where a textured surface is applied to both the binder surface 630 and the upper die perimeter surface 610 thus creating both a binder textured surface 600 and an upper die perimeter textured surface 620. Applying the textured surface to both components increases the coefficient of friction between both die components and the sheet metal and therefore provides more control over the sheet metal during the forming process. Furthermore, it should be noted that the textured die surface can also be applied to the upper die perimeter surface 610 only. Finally, it should also be noted that the textured surface can be applied to only a portion of the binder surface and/or the upper die perimeter surface.

By replacing the lock and draw beads with the textured surface, a higher coefficient of friction can be achieved while eliminating some of the drawbacks associated with the beads such as wear, repair, stringers, wrinkles and the requirement for extra sheet metal stock. Note that draw and lock beads are machined directly into the die material and are naturally high wear components that require frequent maintenance and repair. The particles used in the textured die surfaces typically consist of a harder material than the die base material and also can typically encompass a height range of 0.10 mm to 0.75 mm whereas a typical lock bead height dimension can be approximately 8 mm. The carbide particle textured surface, for example, has improved wear characteristics over typical die materials, such as SAE G3500–Alloyed Grey Cast Iron or SAE0050A—Cast Steel, which are also used for the integrated draw and/or lock beads. Thus, the material as well as the size of the textured die surface particles enhance the textured die surface's wear characteristics as compared to draw and/or lock beads.

In addition, using the textured surface in place of the draw and/or lock beads allows for a reduction of the sheet metal blank size and therefore a corresponding cost savings. By not using the draw and/or lock beads, the blank size can be reduced by the amount of material that would have to be formed into the draw and/or lock bead configuration thus saving money in the piece cost of the sheet metal components. Furthermore, the textured surface will not create the uplifting force that draw and lock beads do and therefore press tonnage can potentially be reduced also saving money in manufacturing expenses. Finally, eliminating the draw and/or lock beads in favor of the textured surface will also require less press travel and therefore provide the opportunity, combined with the requirement for less tonnage, to use a smaller press than would be required for the same component with beads.

The foregoing description constitutes the embodiments devised by the inventors for practicing the invention. It is apparent, however, that the invention is susceptible to modification, variation, and change that will become obvious to those skilled in the art. Inasmuch as the foregoing description is intended to enable one skilled in the pertinent art to practice the invention, it should not be construed to be limited thereby but should be construed to include such aforementioned obvious variations and be limited only by the proper scope or fair meaning of the accompanying claims.

What is claimed is:

1. A die assembly for draw forming sheet metal stock into a desired part, the die assembly comprising:

first die assembly having an inner die surface arranged to engage one surface portion of the sheet metal stock during the forming operation and a perimeter die surface further arranged to engage one surface of a perimeter portion of the sheet metal stock;

a second die assembly comprising an inner die surface for engaging an opposite surface portion of the sheet metal stock during the forming operation;

a binder assembly arranged to encompass the second die assembly and having a surface further arranged to engage an opposite perimeter surface portion of the sheet metal stock to clamp the sheet metal stock between the binder surface and the first die perimeter surface during the forming operation; and a textured surface formed on and metallurgically bonded to the binder surface by direct metal deposition of a plurality of particles into the binder surface, wherein the textured surface is arranged to increase the coefficient of friction between the binder surface and the sheet metal when the sheet metal is clamped between the binder surface and the first die assembly perimeter surface during a draw forming process.

2. The die assembly of claim 1, wherein the plurality of particles comprises particles having varying melting properties introduced during the direct metal deposition process.

3. The die assembly of claim 1, wherein the textured surface comprises a random pattern of particles of varying sizes.

4. The die assembly of claim 1, wherein the plurality of particles comprises particles of a harder material than the binder base metal.

5. The die assembly of claim 1, wherein the plurality of particles are arranged to form at least one bead raised from the surface of the binder, the particles consisting of a harder material than the binder base metal.

6. The die assembly of claim 5, wherein the at least one bead consists of a plurality of beads, said plurality of beads arranged in a predetermined pattern.

7. The die assembly of claim 1, wherein the plurality of particles are further applied to at least a portion of the first die assembly perimeter surface arranged to engage the one surface of the perimeter portion of the sheet metal.

8. The die assembly of claim 7, wherein the plurality of particles comprises particles having varying melting properties introduced during the direct metal deposition process.

9. The die assembly of claim 7, wherein the textured surface comprises a random pattern of particles of varying sizes.

10. The die assembly of claim 7, wherein the plurality of particles are arranged to form at least one bead raised from each of the surfaces of both the binder and the first die assembly perimeter surface, the particles consisting of a harder material than the binder and the first die assembly base metals.

11. The die assembly of claim 10, wherein the at least one bead consists of a plurality of beads.

12. The die assembly of claim 11, wherein the plurality of beads are arranged in a predetermined pattern.

13. The die assembly of claim 7, wherein the plurality of particles comprises particles of a harder material than the binder and first die assembly base metals.

14. The die assembly for draw forming sheet metal stock into a desired part, the die assembly comprising:

a first die assembly having an inner die surface arranged to engage one surface portion of the sheet metal stock during the forming operation and a perimeter die surface further arranged to engage one surface of a perimeter portion of the sheet metal stock;

a second die assembly comprising an inner die surface for engaging an opposite surface portion of the sheet metal stock during the forming operation;

a binder assembly arranged to encompass the second die assembly and having a surface further arranged to engage an opposite perimeter surface portion of the sheet metal stock to clamp the sheet metal stock between the binder surface and the first die perimeter surface during the forming operation; and a textured surface formed on and metallurgically bonded to the first die assembly perimeter surface by direct metal deposition of a plurality of particles into the first die assembly perimeter surface, wherein the textured surface is arranged to increase the coefficient of friction between the first die assembly perimeter surface and the sheet metal when the sheet metal is clamped between the first die assembly perimeter surface and the binder surface during a draw forming process.

15. The die assembly of claim 14, wherein the plurality of particles comprises particles having varying melting properties and sizes introduced during the direct metal deposition process.

16. The die assembly of claim 14, wherein the plurality of particles are arranged to form at least one bead raised from the surface of the first die assembly perimeter surface, the particles consisting of a harder material that the first die assembly base metal.

17. The die assembly of claim 16, wherein the at least one bead consists of a plurality of beads, said plurality of beads arranged in predetermined pattern.

* * * * *